US008221171B2

(12) United States Patent
Ono et al.

(10) Patent No.: US 8,221,171 B2
(45) Date of Patent: Jul. 17, 2012

(54) CRIMP TERMINAL, TERMINAL-PROVIDED WIRE, AND MANUFACTURING METHOD THEREOF

(75) Inventors: Junichi Ono, Yokkaichi (JP); Hiroki Hirai, Yokkaichi (JP); Tetsuji Tanaka, Yokkaichi (JP); Hiroki Shimoda, Yokkaichi (JP); Takuji Otsuka, Yokkaichi (JP); Shigeru Ogihara, Yokkaichi (JP); Akira Ito, Yokkaichi (JP)

(73) Assignees: Autonetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 179 days.

(21) Appl. No.: 12/734,331

(22) PCT Filed: Oct. 31, 2008

(86) PCT No.: PCT/JP2008/069843

§ 371 (c)(1), (2), (4) Date: Apr. 26, 2010

(87) PCT Pub. No.: WO2009/057734

PCT Pub. Date: May 7, 2009

(65) Prior Publication Data

US 2010/0261391 A1 Oct. 14, 2010

(30) Foreign Application Priority Data

Nov. 1, 2007 (JP) ..... 2007-285206

(51) Int. Cl.
*H01R 4/18* (2006.01)

(52) U.S. Cl. ..... 439/877

(58) Field of Classification Search ..... 439/421, 439/423, 877, 882; 29/863; 174/84 C
See application file for complete search history.

(56) References Cited

U.S. PATENT DOCUMENTS 2,674,725 A * 4/1954 Buchanan ..... 439/882
2,692,422 A * 10/1954 Pierce ..... 29/865
2,800,638 A * 7/1957 Hammell ..... 439/882
(Continued)

FOREIGN PATENT DOCUMENTS

JP U-55-007235 1/1980
(Continued)

OTHER PUBLICATIONS

International Search Report issued in Application No. PCT/JP2008/069843; Mailed on Jan. 20, 2009 (With Translation).
(Continued)

*Primary Examiner* — Neil Abrams
(74) *Attorney, Agent, or Firm* — Oliff & Berridge, PLC

(57) ABSTRACT

Provided is a technique of ensuring mechanical strength in a terminal-provided wire and lowering contact resistance between the wire and the crimp terminal, without greatly varying a crimp height of a crimp terminal onto the wire in an axial direction. A crimp terminal according to the invention includes a conductor barrel which is crimped to a conductor of a wire. The conductor barrel has an inner surface which closely contacts the conductor by bending. The inner surface has such a shape a surface thereof which closely contacts a tip end side part of the conductor inwardly projects beyond a surface thereof which closely contacts a base side part of the conductor, thus performing a higher compression of the tip end side part of the conductor than that of the base side part thereof by the bending.

17 Claims, 13 Drawing Sheets

U.S. PATENT DOCUMENTS

| | | | | |
|---|---|---|---|---|
| 2,863,132 | A * | 12/1958 | Sowa | 439/730 |
| 3,594,713 | A * | 7/1971 | Thoman | 439/730 |
| 4,003,623 | A * | 1/1977 | Reynolds | 439/395 |
| 4,142,771 | A * | 3/1979 | Barnes et al. | 439/442 |
| 4,692,122 | A * | 9/1987 | Montalbano | 439/882 |
| 7,207,850 | B2 * | 4/2007 | Takayama | 439/852 |
| 7,867,014 | B2 * | 1/2011 | Kuwayama | 439/452 |
| 7,874,881 | B1 * | 1/2011 | Sosa et al. | 439/877 |
| 8,070,536 | B2 * | 12/2011 | Ono et al. | 439/877 |
| 2010/0261391 | A1 * | 10/2010 | Ono et al. | 439/877 |

FOREIGN PATENT DOCUMENTS

| | | |
|---|---|---|
| JP | U-57-086266 | 5/1982 |
| JP | U-59-10695 | 4/1984 |
| JP | U-60-4381 | 2/1985 |
| JP | A-2005-050736 | 2/2005 |

OTHER PUBLICATIONS

Jan. 31, 2012 Notice of Reasons for Rejection in JP Appln. No. 2007-285206, w/English translation.

* cited by examiner

CRIMP TERMINAL, TERMINAL-PROVIDED WIRE, AND MANUFACTURING METHOD THEREOF

FIELD OF THE INVENTION

The present invention relates to a crimp terminal which is crimped to an end of a wire provided for an automobile or the like, a terminal-provided wire including the crimp terminal, and a manufacturing method thereof.

BACKGROUND ART

To attach a terminal to an end of an insulated wire, there is conventionally often used a crimping technique. The crimping is performed by caulking a conductor barrel formed in advance on the terminal to the end of a conductor of the insulated wire by use of a die.

This crimping technique, however, involves a difficulty of setting a crimp height of the conductor barrel. A low crimp height has a merit of lowering contact resistance between the conductor barrel and the conductor, while causing a demerit of decreasing mechanical strength, in particular tensile strength against an impact load (more specifically, the strength by which the crimp terminal holds the wire), because of a high reduction rate of the conductor sectional area. On contrary, a high crimp height has a merit of maintaining high mechanical strength while raising the contact resistance between the conductor barrel and the conductor of the wire.

Particularly in recent years, there is conducted a study on the use of aluminum or aluminum alloy as the material of the conductor included in the wire, the use of these materials involving extremely difficulty of setting the crimp height. Specifically, a surface of the aluminum or aluminum alloy tends to be formed with an oxide film which causes a deterioration in contact resistance; there is required setting a low crimp height low in order to lower a contact resistance sufficiently in spite of the formed oxide film. This means that it is not easy to set and manage the crimp height of a terminal-provided wire including a conductor made of aluminum or an aluminum alloy so as to satisfy both of mechanical strength and contact resistance requirements.

For this purpose, Patent Document 1 discloses a technique of forming simultaneously a high crimp height part and a low crimp height part in a conductor barrel. The high crimp height part is formed on a tip end side part of the conductor to contribute to mechanical strength maintenance, while the low crimp height part contributes to a lowered contact resistance.

The terminal-provided wire described in Patent Document 1, however, involves an existence of a discontinuous step between the high crimp height part and the low crimp height part of the terminal. The larger the step, the more likely damage such as cracks is given to the terminal. Furthermore, it is practically difficult to manufacture a terminal-provided wire including such a large step by use of a single crimping die; in actuality, separate crimping dies must be used for the different crimp height parts, management of which involves extreme troublesome.

Patent Document 1: Japanese Patent Application Publication No. 2005-50736

SUMMARY OF THE INVENTION

It is an object of the present invention to provide a technique which enables both of ensuring mechanical strength in a terminal-provided wire and lowering contact resistance between the wire and the crimp terminal to be established, while not greatly varying a crimp height of a crimp terminal onto the wire in an axial direction.

For this object, the present invention provides a crimp terminal having an electric connection portion which is fitted to a counterpart terminal to thereby electrically connected thereto, and a wire crimp portion which is crimped onto an end of a wire in which end a conductor is exposed. The wire crimp portion includes a basal portion extending from the electric connection portion in an axial direction, and a conductor barrel which is formed of a metal plate extending from the basal portion across the axial direction and is bent so as to hold the exposed conductor on the end of the wire. The conductor barrel has an inner surface which is brought into close contact with the conductor by the bending of the conductor barrel; the inner surface, including a first inner surface which closely contacts a base side part of the conductor and a second inner surface which closely contacts a tip end side part of the conductor, has such a shape that the second surface inwardly projects beyond the first surface to perform, by the bending, a higher compression of the tip end side part of the conductor than that of the base side part of the conductor.

Wherein, "a higher compression" indicates that the wire crimp portion of the crimp terminal is crimped onto the conductor of the wire by a larger force, thereby compressing the conductor by a larger force. The compression of the conductor of the wire by the crimping force makes a sectional area of the conductor after the crimping smaller than that of the conductor before the crimping; the ratio of the first sectional area of the conductor after the crimping to the second sectional area before the crimping is hereafter called a "compression ratio". This means that a higher compression involves a low compression ratio while a suppressed compression involves a relatively high compression ratio.

The present invention further provides a terminal-provided wire comprising a wire having an end in which a conductor is exposed and the crimp terminal crimped to the end, the conductor barrel of the crimp terminal being bent to be crimped onto the conductor on the end of the wire so as to hold the conductor.

According to the crimp terminal and the terminal-provided wire, the second inner surface, which is a part of the inner surface of the conductor barrel of the crimp terminal and closely contacts the tip end side part of the conductor, inwardly projects beyond the second surface which closely contacts the base side part of the conductor; this makes it possible to establish both of ensuring the sufficient mechanical strength in the terminal-provided wire and lowering contact resistance, without greatly varying the crimp height of the conductor barrel in the axial direction.

The present invention further provides a method of manufacturing a terminal-provided wire comprising a wire having an end in which a conductor is exposed and a crimp terminal crimped to the end, the method including: a terminal forming step of forming the above-mentioned crimp terminal from a metal plate; and a crimping step of crimping the conductor barrel of the crimp terminal onto the conductor by setting the conductor in the end of the wire onto the wire crimp portion of the crimp terminal and bending the conductor barrel such that the conductor barrel holds the conductor on the end of the wire. This method makes it possible to manufacture a terminal-provided wire given both of ensured mechanical strength and lowered contact resistance simply by previously forming the crimp terminal having the conductor barrel and thereafter crimping the conductor barrel of the crimp terminal to the conductor on the end of the wire.

DESCRIPTION OF THE PREFERRED EMBODIMENTS

Preferred embodiments of the present invention will be described below with reference to the drawings.

Figure 1:
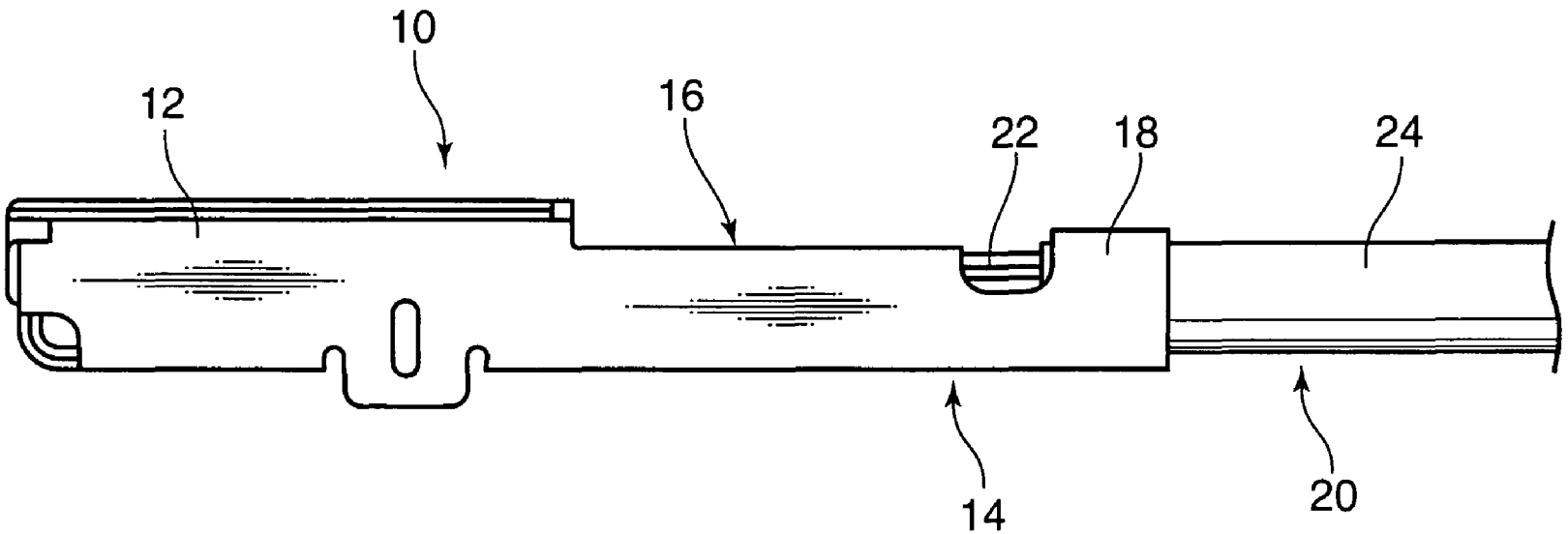
FIG. 1 is a side view of a terminal-provided wire according to a first embodiment of the present invention.

FIG. 1 shows a terminal-provided wire manufactured according to a first embodiment of the present invention. This terminal-provided wire includes a wire 20 and a crimp terminal 10. The wire 20 is formed of a conductor 22 and an insulating covering 24 covering the conductor 22 from a radial outer side. There is removed a part of the insulation covering 24 in an end of the wire 20 to partially expose the conductor 22. Onto this end of the wire 20, the crimp terminal 10 is crimped.

The conductor 22 is not limited to its material: various materials in addition to typically employed copper and copper alloy are permitted to be used. However, the present invention is particularly effective in the case where the conductor is formed from a material, such as aluminum or aluminum alloy, whose surface tends to be formed with an oxide film causing a requirement of a high degree of compression during the crimping.

The terminal-provided wire is manufactured through the following terminal forming process and crimping process.

1) Terminal Forming Process

Figure 2:
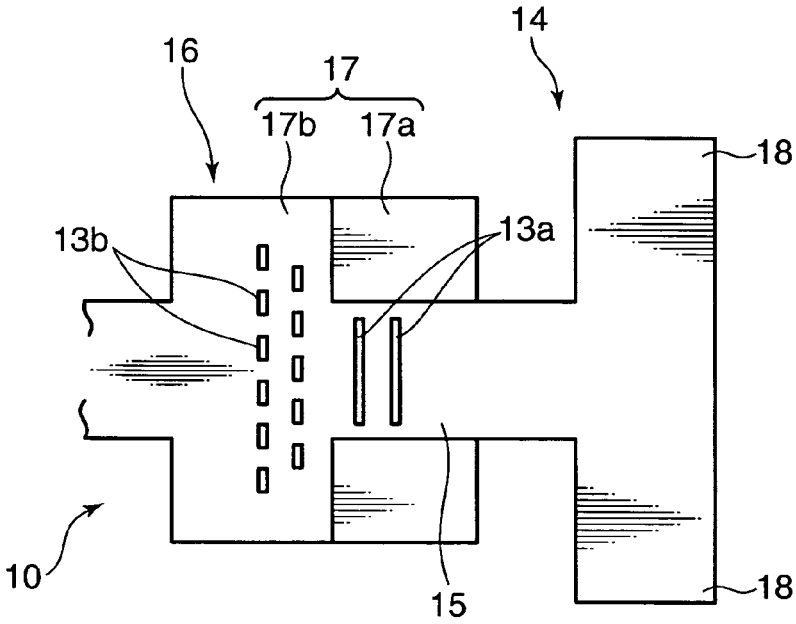
FIG. 2 is a development of a crimp terminal according to the first embodiment of the present invention.
Figure 3:
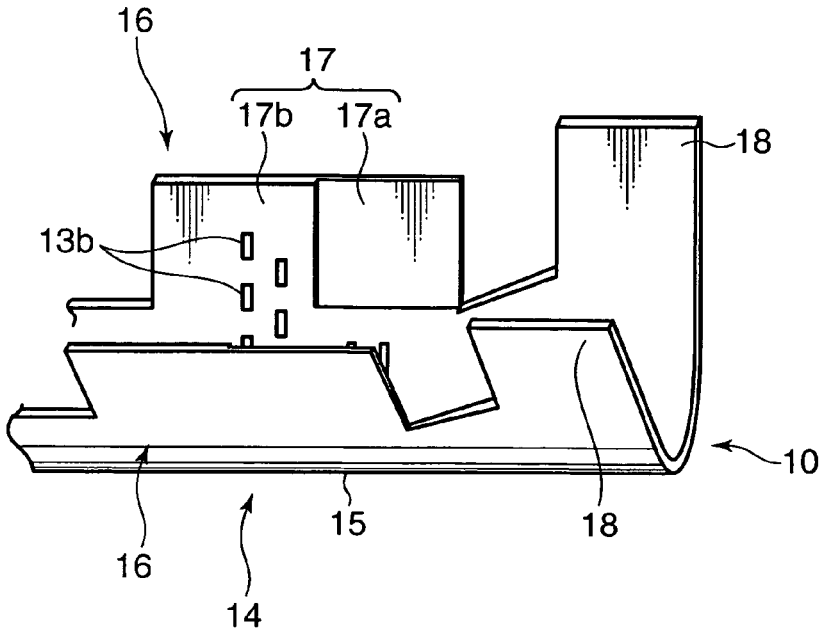
FIG. 3 is a perspective view showing a formed shape of the crimp terminal in FIG. 2.

In this process, formed is such a crimp terminal 10 as shown in FIGS. 2 and 3, that is, the crimp terminal 10 in the state before being crimped to the end of the wire. The forming is performed, similarly to a normal terminal, through a process of punching out a terminal original plate, such as that shown in FIG. 2, from a metal plate and bending the terminal original plate.

Similarly to a conventional terminal, the crimp terminal 10 has an electric contact portion 12 and a wire crimp portion 14 at the front and rear, respectively. In this embodiment, the electric contact portion 12 is a female type, formed into a box shape into which a male terminal, not shown in the drawings, can be fitted. The wire crimp portion 14 includes a basal portion 15 extending rearward in an axial direction from the electric contact portion 12, a right-left pair of conductor barrels 16 extending across the axial direction (orthogonally to the axial direction in the drawings) from the basal portion 15, and a right-left pair of insulation barrels 18 extending substantially parallel to the respective conductor barrels 16. Each of the conductor barrels 16 takes a U-shaped front form, as shown in FIG. 3, and the insulation barrels 18 take similar forms.

Each conductor barrel 16 includes an inner surface 17 which is brought into close contact with the conductor 22 of the wire 20 by the bending thereof. The inner surface 17, including a surface (to be referred to hereafter as a "first inner surface") 17*a* which closely contacts a base side part of the conductor and a surface (to be referred to hereafter as a "second inner surface") 17*b* which closely contacts a tip end side part of the conductor 22, has such a shape that the second inner surface 17*b* inwardly projects beyond the first inner surface 17*a* to perform, by the bending, a higher compression of the tip end side part of the conductor than the compression of the base side part of the conductor.

More specifically, the conductor barrel 16 according to this embodiment is press-formed into such a shape that the first inner surface 17*a* is recessed deeply beyond the second inner surface 17*b*. The forming may be performed at the same time as the terminal original plate of the crimp terminal 10 is punched out of the aforementioned metal plate, or after the punching and before the bending process for raising the conductor barrel 16 from the basal portion 15.

On contrast, in this embodiment, the conductor barrel 16 has an outside surface having a uniform height, including no step. Hence, in the conductor barrel 16 according to this embodiment, the part which is crimped to the tip end side part of the conductor 22 is thicker than the part which is crimped to the base side part.

In this embodiment, the wire crimp portion 14 has an inner surface, which is formed with a plurality of first recessed portions 13*a* and a plurality of second recessed portions 13*b*. Each of the recessed portions 13*a* and 13*b* has front and rear edges each extending in a terminal width direction. The edges cut into the conductor 22 to increase the strength by which the crimp terminal 10 holds the conductor 22, and break through the oxide film formed on the surface of the conductor 22 to promote a decrease in contact resistance.

The first recessed portions 13*a* are formed in a region of the basal portion 15 which region is sandwiched between the right and left first inner surfaces 17*a*. The first recessed portions 13*a* are narrow grooves extending continuously in the terminal width direction, arranged parallel to each other in the axial direction of the terminal.

The second recessed portions 13*b* are arranged in a region including the right and left second inner surfaces 17*b* and an inner surface of the basal portion 15 which surface is sandwiched between the second inner surfaces 17*b*. The second recessed portions 13*b* are formed as small rectangular shapes, arranged in two columns to the front and rear. The second recessed portions 13*b* in each column are arranged at intervals in the terminal width direction, and the positions of the second recessed portions 13*b* in the front column are offset from the positions of the second recessed portions 13*b* in the rear column in the terminal width direction. In short, the second recessed portions 13*b* are arranged in a zigzag pattern. This arrangement is to prevent the part where each of the recessed portions is formed to locally decrease the thickness of the part from breaking due to the stretch of the wire crimp portion 14 during the crimping thereof onto the tip end side part of the conductor 22 with the high compression, as will be described below.

Forming the recessed portions is not absolutely required in the present invention, permitted to be omitted. Also the insulation barrel 18 may be omitted, depending on specifications.

2) Crimping Process

Figure 4:
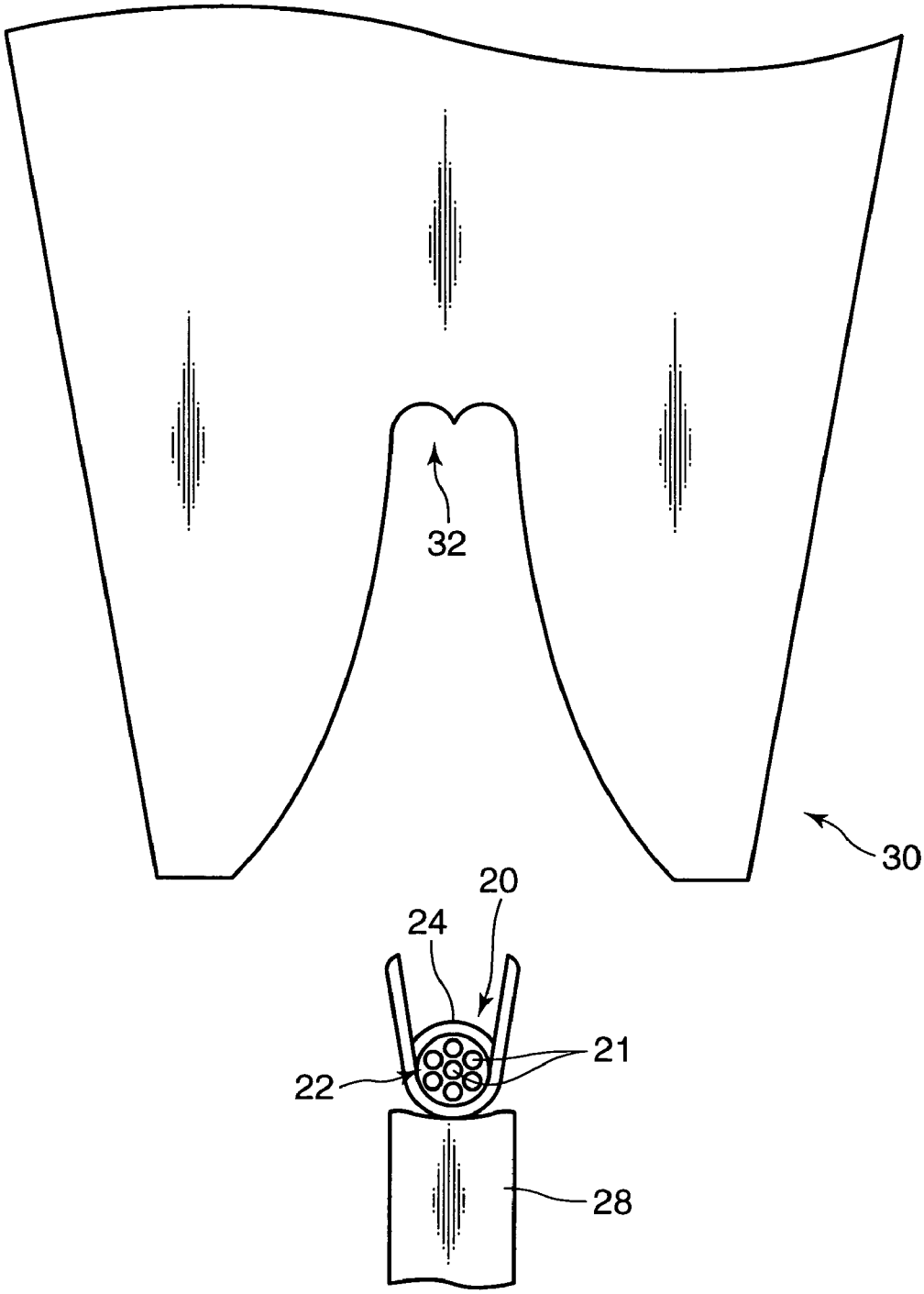
FIG. 4 is a front view showing a crimping process for manufacturing the terminal-provided wire.
Figure 5:
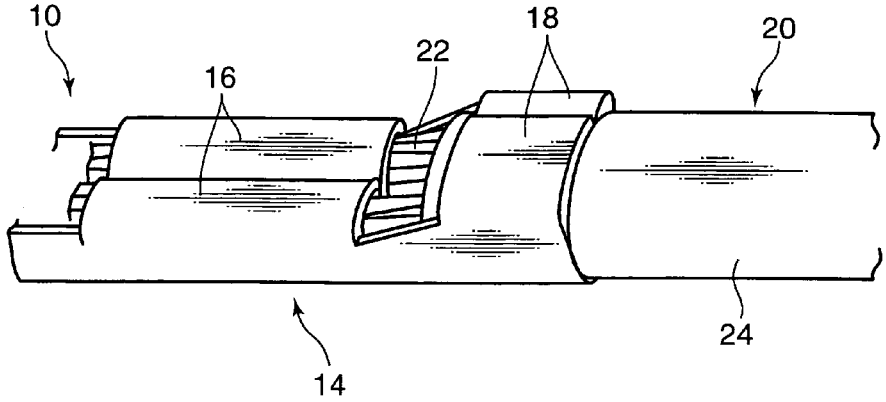
FIG. 5 is a perspective view showing a crimped part of the terminal-provided wire.

In this process, the end of the wire 20 is set on the basal portion 15 of the wire crimp portion 14; in this state, the conductor barrel 16 and the insulation barrel 18 are caulked by a normal die table 28 and a normal die 30 as shown in FIG. 4; thus the wire crimp portion 14 including the respective barrels 16 and 18 is crimped to the conductor 22 on the end of the wire 20 and the insulation covering 24 directly to the rear thereof. More specifically, the crimp terminal 10 and the end of the wire 20 are placed on the die table 28, and the die 30 having a pressing surface 32 corresponding to the post-crimping shape is lowered thereon. The barrels 16 and 18 are thereby bent so as to hold the conductor 22 and the insulation covering 24 respectively.

Figure 6:
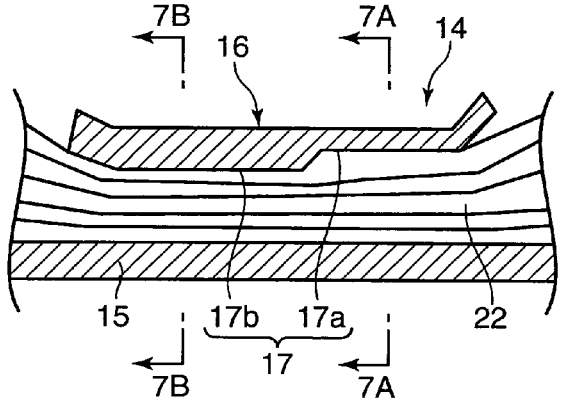
FIG. 6 is a sectional side view of the crimped part.
Figure 7A:
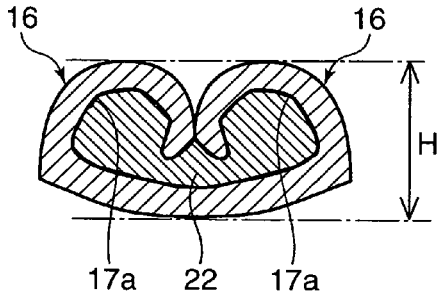
FIG. 7A is a sectional view taken along a 7A-7A line in FIG. 6.
Figure 7B:
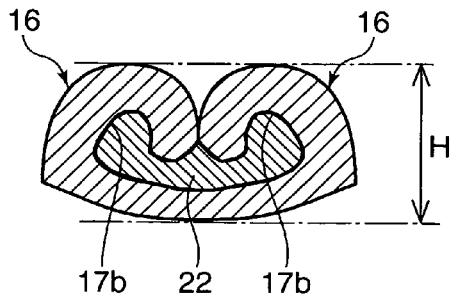
FIG. 7B is a sectional view taken along a 7B-7B line in FIG. 6.

Followed by this, the inner surface 17 of the conductor barrel 16 is formed such that the second inner surface (the inner surface on the conductor tip end side) 17*b* thereof inwardly projects beyond the first inner surface (the inner surface on the conductor base side) 17*a*; this allows the second inner surface 17*b* to perform a higher compression of the conductor 22, as shown in FIGS. 6 and 7, even when the conductor barrel 16 is crimped to the conductor 22, similarly to normal crimping, at a uniform crimp height H over the entire axial direction region as shown in FIGS. 7A and 7B, for example. In other words, a compression ratio on this part (on the tip end side part) is lowered than that (of the base side part) of the conductor 22 given by the first inner surface 17*a*. Such a crimping on the tip end side part of the conductor 22 with the higher compression effectively lowers contact resistance between the conductor 22 and the conductor barrel 16, while suppressing compression in the base side part of the conductor 22 enables high tensile strength of the terminal-provided wire, or more specifically the strength with which the conductor barrel 16 holds the conductor 22, to be ensured. In short, both of lowering the contact resistance and ensuring the sufficient mechanical strength can be established.

Thus establishing both of lowering contact resistance and ensuring the sufficient tensile strength even without forming a large step in the crimp height of the conductor barrel 16 generates the following advantages.

The conventional technique, for example, described in Patent Document 1, which tries to establish lowering contact resistance and ensuring the tensile strength only by the difference between the crimp height on the front side part (i.e. the part which is crimped to the tip end side part of the conductor 22) of the conductor barrel 16 and the crimp height on the rear side part (i.e. the part which is crimped to the base side part of the conductor 22), requires a quite large difference in the crimp. Such a large difference in crimp height causes a large step between the front side part and rear side part of the conductor barrel 16, which step tends to become a factor of cracking the conductor barrel 16. Furthermore, the large difference in crimp height requires each of the parts to be crimped by use of separate dies, which makes the dimension management of the crimping operation extremely difficult. Particularly the conductor 22 made of aluminum or aluminum alloy may require such a low compression ratio as 40% to 70% (i.e., a high degree of compression) for breaking through the oxide film formed on the surface of the conductor 22 to lower the surface resistance thereof: ensuring the low compression ratio and the high mechanical strength requires the step to be extremely large.

On contract, in the crimping process according to this embodiment, the shape of the inner surface of the pre-formed conductor barrel 16 can give a difference between the compression ratios of respective front and rear parts even when there is no difference in the crimp height between the front and rear parts, that is, even when the uniform crimp height H is set in the axial direction, thereby enables the crimp terminal 10 to be easily crimped involving no large step in the conductor barrel 16. Even in the case where the difference in crimp height is applied, the difference can be set small, not required to be large. This results in a great improvement of the defects in the conventional technique described above.

Figure 8:
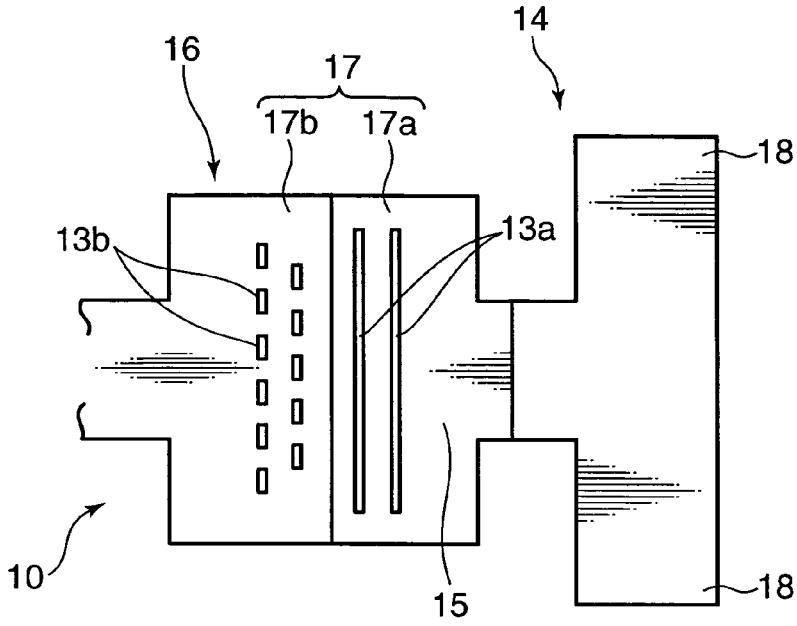
FIG. 8 is a development of a crimp terminal according to a second embodiment of the present invention.
Figure 9:
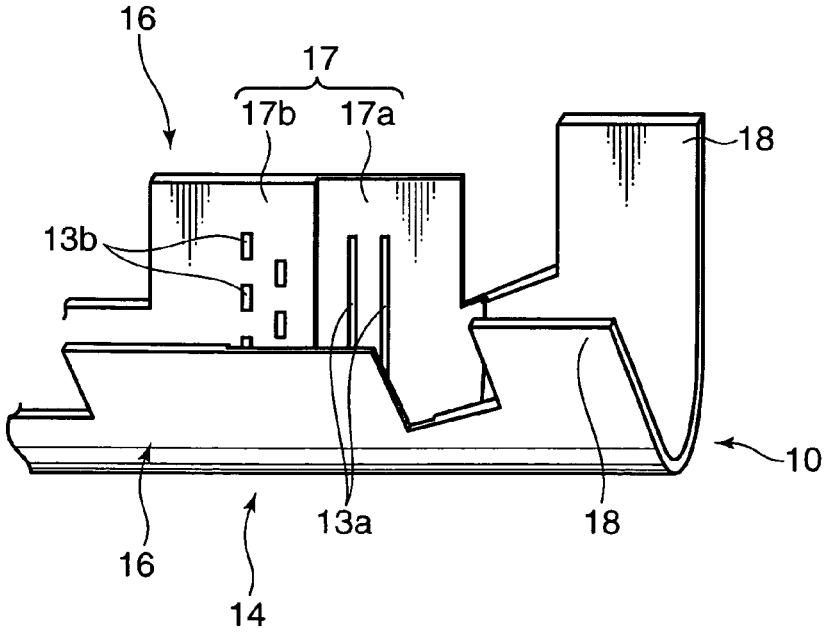
FIG. 9 is a perspective view showing a formed shape of the already formed crimp terminal in FIG. 8.

The aforementioned height difference may be applied not only to the inner surface of the conductor barrel 16 but also to the inner surface of the basal portion 15. For example, as a second embodiment shown in FIGS. 8 and 9, the inner surface of the basal portion 15 sandwiched between the two first inner surfaces 17*a* may be recessed similarly to the first inner surfaces 17*a*. In this case, the first recessed portions 13*a* may be formed, as shown in the drawings, continuously in a region across the inner surface of the basal portion 15 and the first inner surfaces 17*a* on both sides thereof.

Figure 10:
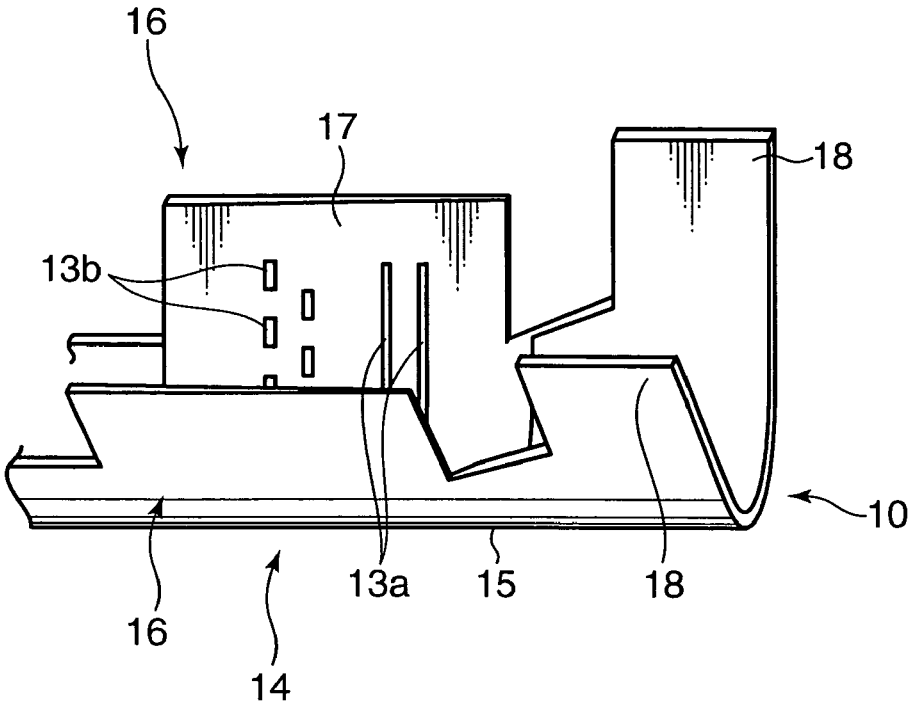
FIG. 10 is a perspective view showing a crimp terminal according to a third embodiment of the present invention.
Figure 11:
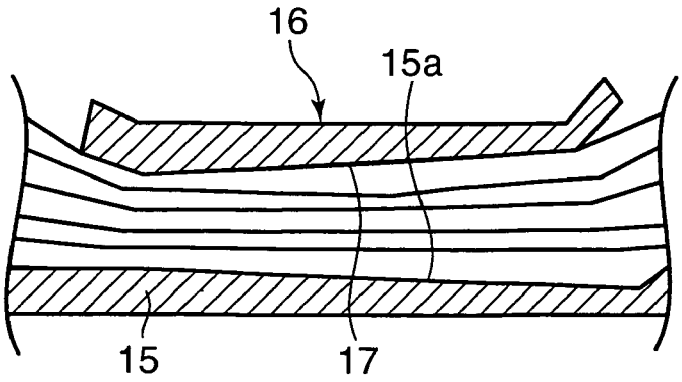
FIG. 11 is a sectional side view of a crimped part of the crimp terminal.

Furthermore, the inner surface of the conductor barrel according to the present invention need not absolutely include a step as described above, permitted to be a tapered surface, like an inner surface 17 shown in FIGS. 10 and 11 as a third embodiment, having an inward projection which gradually increases with closing to the tip end side part of the conductor 22. Also the inner surface 17 having such a shape can give a difference in compression ratio between the tip end side part and the base side part of the conductor 22, and further vary the compression ratio of the conductor 22 smoothly in the axial direction. As other example, radial positions of the inner surface 17 may be given variations in a shape of including three or more steps.

The first inner surface 17*a* and the second inner surface 17*b* having the above-mentioned height difference can be formed also by inwardly folding back an appropriate peripheral edge part of the metal plate constituting the conductor barrel 16, for example. This forming is capable of generating the above effects without an decrease in the thickness of the conductor barrel 16, but with an increase in the thickness thereof, the increase providing high strength.

Figure 12:
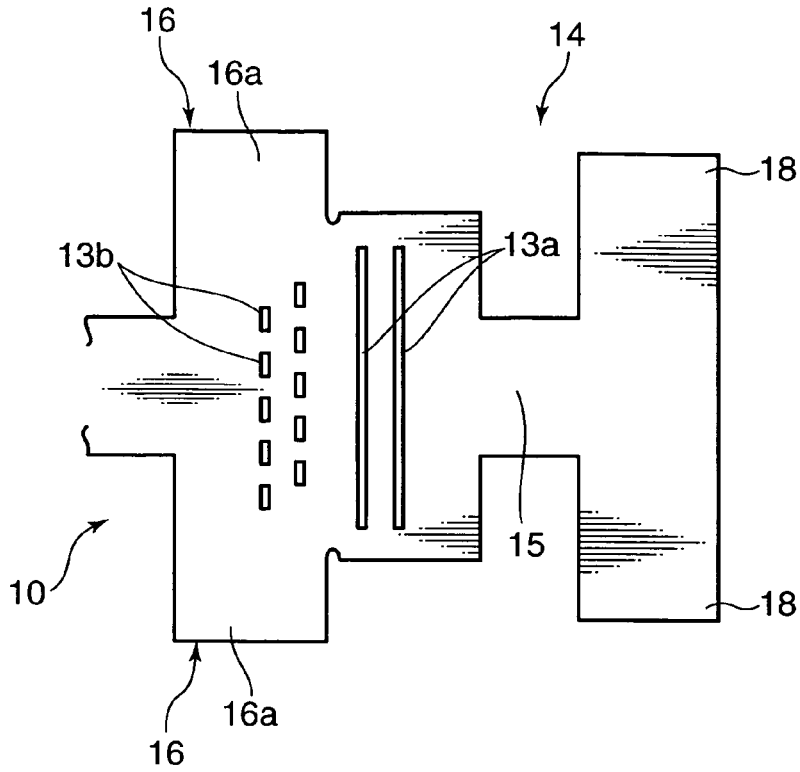
FIG. 12 is a development of a crimp terminal according to a fourth embodiment of the present invention.
Figure 13:
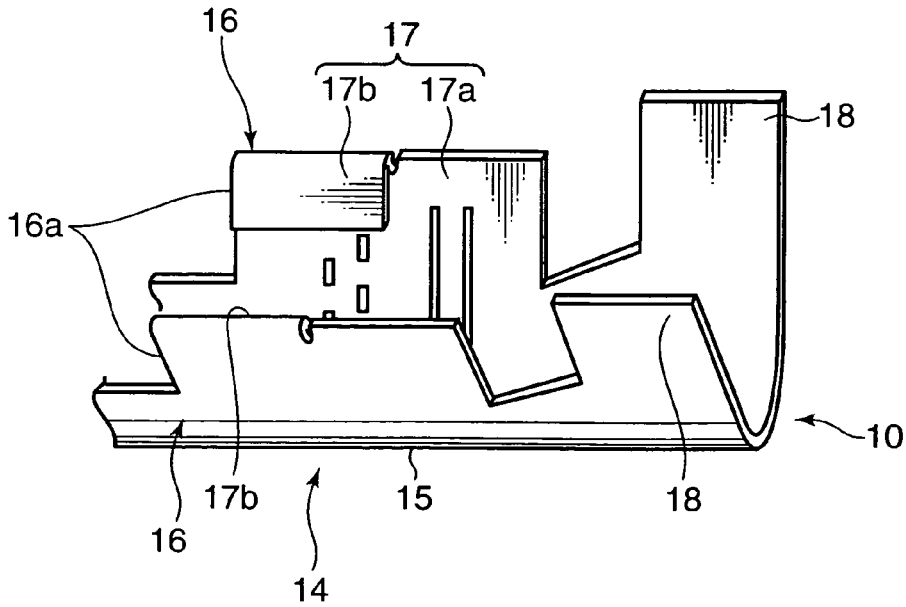
FIG. 13 is a perspective view showing a formed shape of the crimp terminal in FIG. 12.
Figure 14:
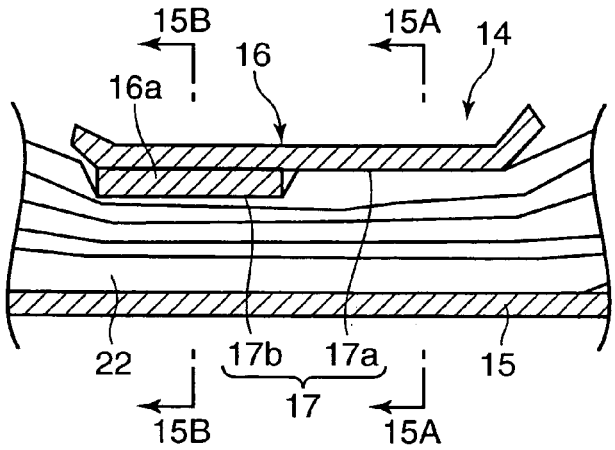
FIG. 14 is a sectional side view of a crimped part of the crimp terminal shown in FIG. 13.
Figure 15A:
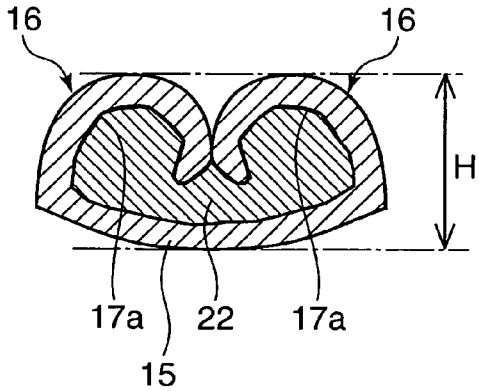
FIG. 15A is a sectional view taken along a 15A-15A line in FIG. 14.
Figure 15B:
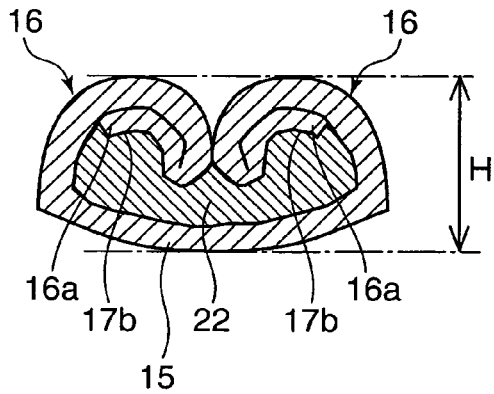
FIG. 15B is a sectional view taken along a 15B-15B line in FIG. 14.

For example, in the crimp terminal 10 shown in FIGS. 12 to 15 as a fourth embodiment, there is formed an extended end portion 16*a* in the metal plate constituting the conductor barrel 16 as shown in FIG. 12; the extended end portion 16*a* extends from only a front side part of a barrel main body part (that is, a part which is crimped to the tip end side part of the conductor 22), in a direction in which the conductor barrel 16 extends, being folded back to the basal portion 15 side. The thus folded-back extended end portion 16*a* has a front side surface which forms the second inner surface 17*b* of the conductor barrel 16 shown in FIGS. 13 and 14.

The second inner surface 17*b*, inwardly projecting beyond the first inner surface 17*a* which is the inner surface of the conductor barrel 16 on the rear side of the extended end portion 16*a*, by the thickness of the extended end portion 16*a*, compresses the tip end side part of the conductor 22 at a lower compression ratio (with a higher compression) than the compression ratio at which the first inner surface 17*a* compresses the base side part of the conductor 22, similarly to the first embodiment, upon the crimp of the conductor barrel 16 onto the conductor 22.

Figure 16:
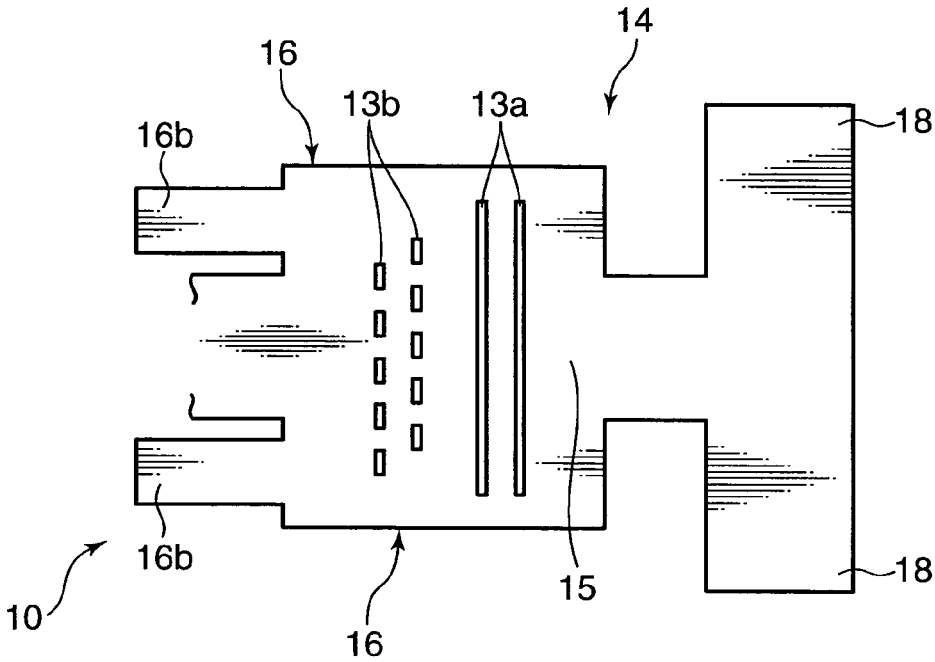
FIG. 16 is a development of a crimp terminal according to a fifth embodiment of the present invention.
Figure 17:
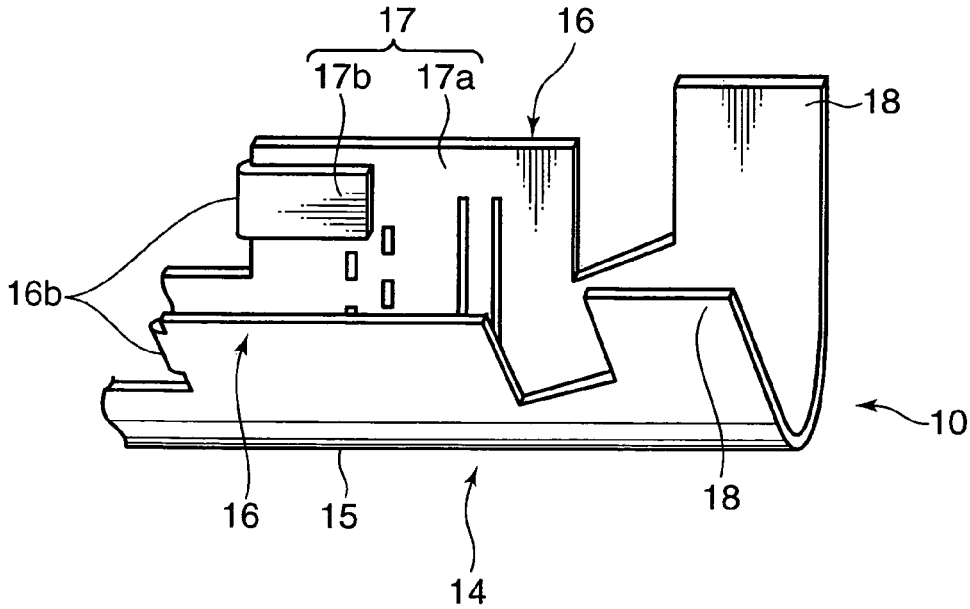
FIG. 17 is a perspective view showing a formed shape of the crimp terminal in FIG. 16 following forming.
Figure 18:
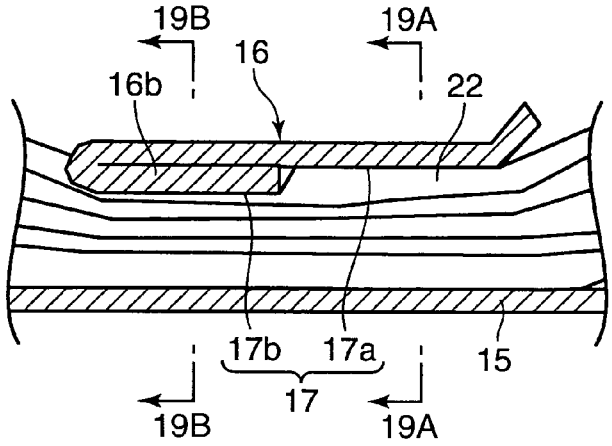
FIG. 18 is a sectional side view of a crimped part of the crimp terminal shown in FIG. 17.
Figure 19A:
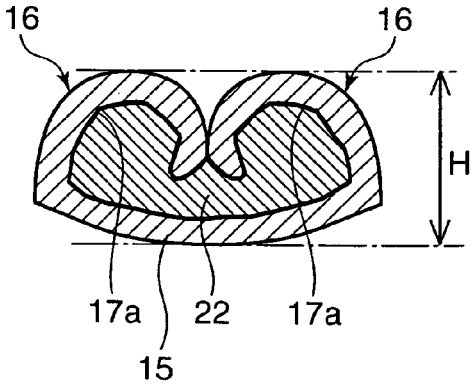
FIG. 19A is a sectional view taken along a 19A-19A line in FIG. 18.
Figure 19B:
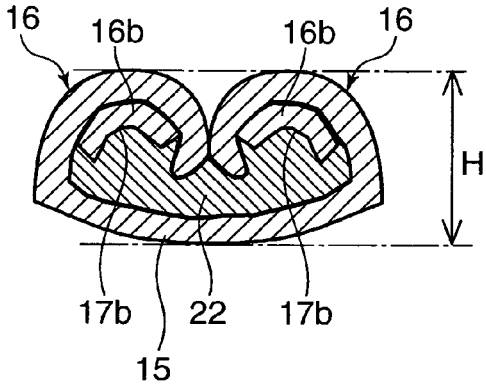
FIG. 19B is a sectional view taken along a 19B-19B line in FIG. 18.

Besides, in the crimp terminal 10 shown in FIGS. 16 to 19 as a fifth embodiment, there is formed an extended portion 16*b* in the metal plate constituting the conductor barrel 16 as shown in FIG. 16; the extended portion 16*b* extends forward (to the tip end side of the conductor 22) in the terminal axis direction from the barrel main body part, being folded back inwardly and rearwardly. The thus folded-back extended portion 16*b* has a front side surface which forms the second inner surface 17*b* of the conductor barrel 16 shown in FIGS. 17 and 18.

In either of the above-described cases, there can be provided a difference in compression ratio between the tip end side part and base side part of the conductor in a simple structure.

Figure 20:
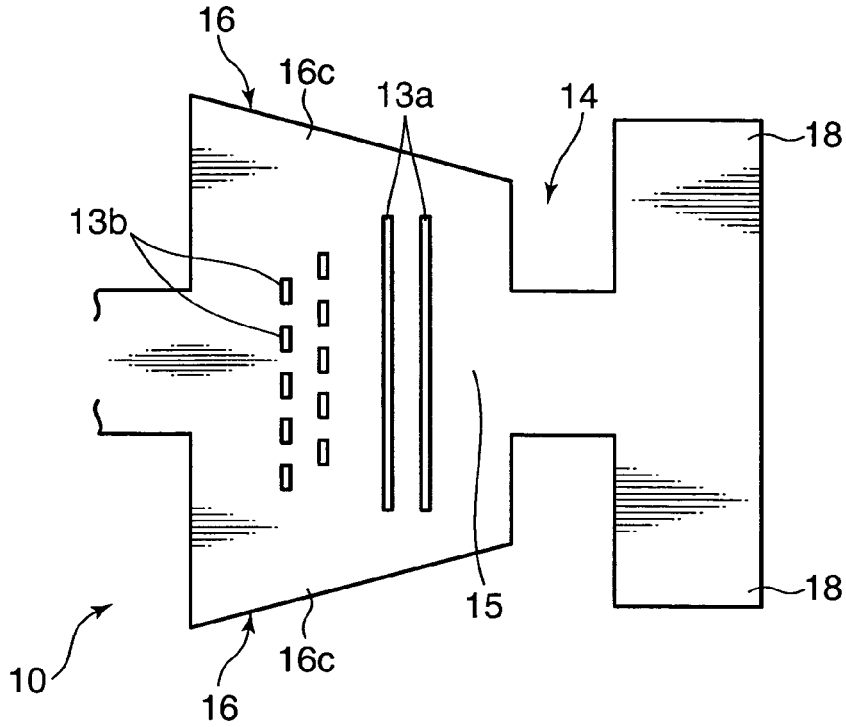
FIG. 20 is a development of a crimp terminal according to a sixth embodiment of the present invention.
Figure 21:
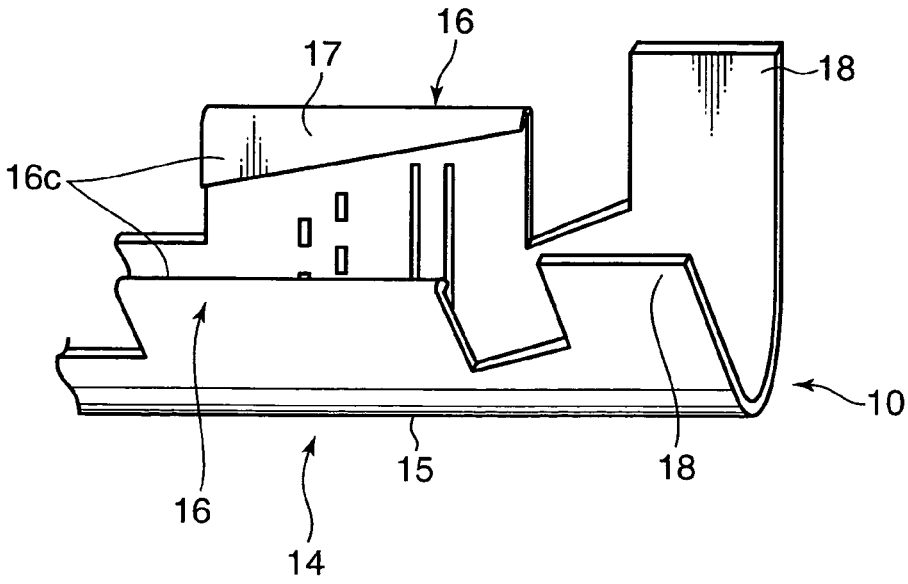
FIG. 21 is a perspective view showing a formed shape of the crimp terminal in FIG. 20.

Furthermore, the folded-back part may be constituted by an outside edge portion 16*c* of the conductor barrel 16 which has a shape shown in FIGS. 20 to 22 as a sixth embodiment. The outside edge portion 16*c* has a shape of having a width increasing with closing to a terminal front side (the tip end side of the conductor 22) from a terminal rear side (the base side of the conductor 22), that is, a shape of having a dimension of the folded-back part in the state that the outside edge portion 16*c* is folded back inwardly toward the basal portion 15 as shown in FIG. 21, which dimension increases with closing to the tip end side of the conductor.

Figure 22A:
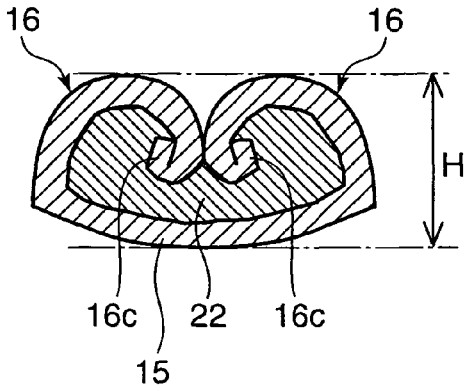
FIG. 22A is a sectional front view of apart of the crimp terminal shown in FIG. 13 which part is crimped to a base side part of a conductor.
Figure 22B:
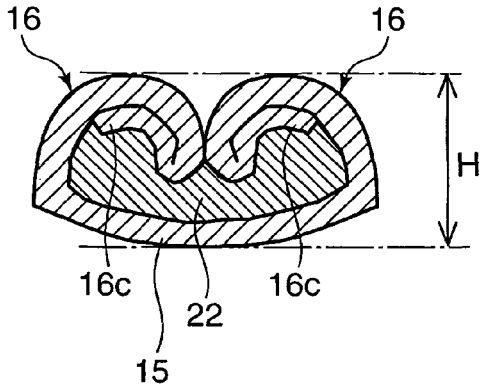
FIG. 22B is a sectional front view showing a part which is crimped to a tip end side part of the conductor.

In the crimp terminal 10 according to this embodiment, the dimension of the folded-back part (i.e. the outside edge portion 16*c*) on the tip end side of the conductor 22 shown in FIG. 22B is greater than the dimension of the folded-back part (the outside edge portion 16*c*) on the base side of the conductor 22 shown in FIG. 22A, further increasing continuously with closing to the tip end side of the conductor 22. This reduces the compression ratio of the conductor 22 continuously with closing to the tip end side to perform a high compression.

Figure 23:
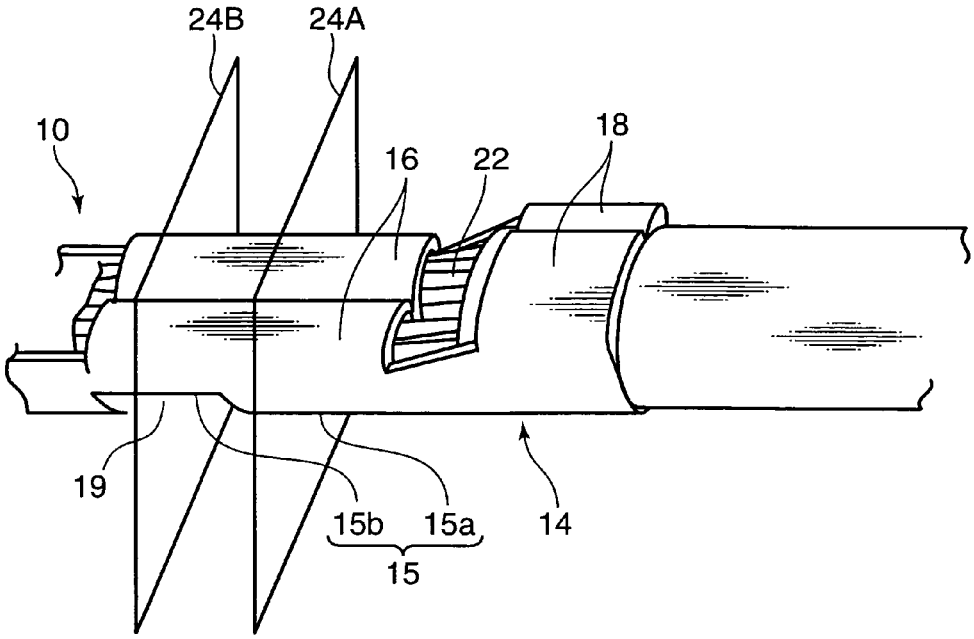
FIG. 23 is a perspective view of a crimped part of a terminal-provided wire according to a seventh embodiment of the present invention.
Figure 24A:
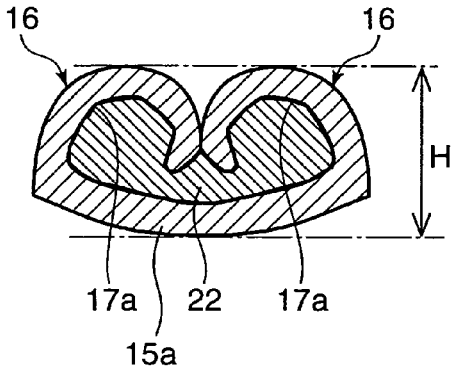
FIG. 24A is a view showing a cross-section 24A in FIG. 23.
Figure 24B:
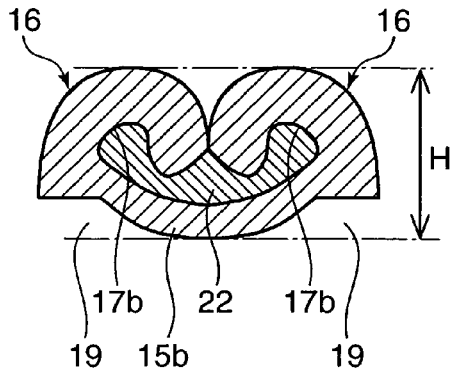
FIG. 24B is a view showing a cross-section 24B in FIG. 23.

The present invention permits other means for adjusting compression ratio to be provided to the wire crimp portion 14, in addition to setting the shape of the inner surface 17 of the conductor barrel 16. For example, in a terminal-provided wire shown in FIGS. 23 and 24 as a seventh embodiment, recessed portions 19 are formed in only a front side part (the part which is crimped to the tip end side part of the conductor 22) 15*b* of the basal portion 15 of the crimp terminal 10 on respective right and left sides of the part 15*b*, thus making the inner surface of the front side part 15*b* corresponding to the tip end side part of the conductor 22 be protruded inwardly and radially of the conductor 22 beyond a rear side part 15*a* corresponding to the base side part of the conductor 22, by an dimension corresponding to that of the recess. The protrusion contributes the higher compression of the conductor 22, decreasing the compression ratio of the same part. The recessed portion 19 may be formed together with crimping the terminal.

The present invention does not exclude an embodiment of providing a difference in crimp height between the front side part and rear side part of the conductor barrel 16 similarly to the prior art, in addition to setting the shape of the inner surface 17 of the conductor barrel 16. Also in this case, the compression ratio difference given by the shape of the inner surface 17 allows the crimp height difference to be small, thus improving the defects in the related art described above.

As described above, the present invention provides a technique of establishing both of ensuring mechanical strength in a terminal-provided wire and lowering contact resistance between the wire and the crimp terminal, without greatly varying, in an axial direction, a crimp height of a crimp terminal onto the wire. Specifically, the present invention provides a crimp terminal having an electric connection portion which is fitted to a counterpart terminal to thereby make electrical connection therewith and a wire crimp portion which is crimped to an end of a wire in which end a conductor is exposed. The wire crimp portion includes a basal portion extending in an axial direction from the electric connection portion and a conductor barrel which is formed of a metal plate extending from the basal portion across the axial direction and is bent so as to hold the exposed conductor in the end of the wire. The conductor barrel includes an inner surface which is brought into close contact with the conductor by the bending of the conductor barrel; the inner surface, including a first inner surface which closely contacts a base side part of the conductor and a second inner surface which closely contacts a tip end side part of the conductor, has such a shape that the second surface inwardly projects beyond the first surface to perform, by the bending, a higher compression of the tip end side part of the conductor than that of the base side part of the conductor.

Wherein, "a higher compression" indicates that the wire crimp portion of the crimp terminal is crimped onto the conductor of the wire by a larger force, thereby compressing the conductor by a larger force. The compression of the conductor of the wire by the crimping force makes a sectional area of the conductor after the crimping smaller than that of the conductor before the crimping; the ratio of the first sectional area of the conductor after the crimping to the second sectional area before the crimping is hereafter called a "compression ratio". This means that a higher compression involves a low compression ratio while a suppressed compression involves a relatively high compression ratio.

According to the crimp terminal described above, the shape of the inner surface of the conductor barrel of the crimp terminal establishes both of ensuring mechanical strength in the terminal-provided wire and lowering contact resistance between the wire and the crimp terminal, without greatly varying the crimp height in the axial direction of the crimp terminal as in the related art. Specifically, the second inner surface which closely contacts the tip end side part of the conductor, inwardly projecting beyond the first surface which closely contacts the base side part of the conductor, contacts the tip end side part of the conductor by higher contact pressure, thereby lowering the contact resistance with the conductor. Meanwhile, the first inner surface which closely contacts the base side part suppresses the compression of the base side part of the conductor, thereby ensuring a larger sectional area in the base side part, which enables a sufficient mechanical strength in this part (in particular, the strength by which the crimp terminal holds the conductor) to be ensured.

More specifically, the conductor barrel may be formed into such a shape that the first inner surface which closely contacts the base side part of the conductor is recessed beyond the second inner surface which closely contacts the tip end side part of the conductor, or a specific peripheral edge part of the metal plate constituting the conductor barrel may be folded back inwardly such that a front surface of the folded-back part forms a front side part of the inner surface of the conductor barrel. In either of the cases, a difference in compression ratio can be applied between the tip end side part and base side part of the conductor in a simple structure. In other words, it is possible to perform a higher compression of the tip end side part of the conductor to lower the compression ratio thereof while suppressing a compression of the base side part to relatively increase the compression ratio thereof.

In the latter case, the conductor barrel may have such a shape that: the barrels extend from right and left sides of the basal portion respectively; an end, in an direction in which the conductor barrel of metal plates extend, of the metal plate forming the conductor barrel is inwardly folded back; and the folded-back part has a dimension which increases with closing a tip end side of the conductor. This structure enables the compression ratio of the conductor to be smoothly varied in the axial direction.

The present invention further provides a terminal-provided wire including a wire having an end in which a conductor is exposed and the crimp terminal described above crimped to the end, the conductor barrel of the crimp terminal crimped onto the conductor by the bending so as to hold the conductor on the end of the wire.

In this terminal-provided wire, the conductor barrel may be crimped onto the conductor so as to make a crimp height of the conductor barrel uniform in the axial direction. Such a uniform crimp height can be easily managed and has a merit on the strength of the crimp terminal. Moreover, in spite of the uniform crimp height, the shape of the inner surface of the conductor barrel establishes both of ensuring the mechanical strength and lowering the contact resistance as described above.

In the terminal-provided wire, the shape of the basal portion may be constant in the axial direction, or a part of the basal portion corresponding to the tip end side part of the conductor may be protruded inwardly radially of the conductor beyond a part corresponding to the base side part of the conductor. The latter shape enables the compression ratio difference between the tip end side part and the base side part of the conductor to be increased.

The present invention further provides a method of manufacturing a terminal-provided wire comprising a wire having an end in which a conductor is exposed and a crimp terminal crimped to the end, the method including: a terminal forming step of forming the above-mentioned crimp terminal from a metal plate; and a crimping step of crimping the conductor barrel of the crimp terminal onto the conductor by setting the conductor in the end of the wire onto the wire crimp portion of the crimp terminal and bending the conductor barrel such that the conductor barrel holds the conductor on the end of the wire.

In this method, simply forming a crimp terminal having the above-mentioned features and then crimping the conductor barrel of the crimp terminal normally (i.e. without greatly varying the conductor height in the axial direction) can provide a difference in compression ratio between the tip end side part and the base side part of the conductor, thereby allowing both of ensuring mechanical strength in the terminal-provided wire and lowering contact resistance to be established.

In the terminal forming step, a first inner surface which is a part of the inner surface of the conductor barrel and closely contacts a base side part of the conductor may be press-formed into such a recessed shape that a second inner surface which is a part of the inner surface of the conductor barrel and closely contacts a tip end side part of the conductor inwardly projects beyond the first surface. This method allows the inner surface of the conductor barrel to be given a preferred shape through a simple process.

In the terminal forming step, it may be performed to fold back a specific peripheral edge part of the metal plate constituting the conductor barrel inwardly so as to let a front surface of the folded-back part form a front side part of the inner surface of the conductor barrel. This method makes it possible to give a preferred shape to the inner surface of the conductor barrel without decreasing the thickness of the conductor barrel but increasing the thickness thereof, which increases a strength thereof.

In the crimping step, the basal portion of the wire crimp portion of the crimp terminal may be deformed such that a part of the basal portion corresponding to the tip end side part of the conductor has a shape of protruding inwardly and radially of the conductor beyond a part corresponding to the base side part of the conductor.

The invention described above is particularly effective in the case of requiring a crimp with a high compression, that is, a crimp at a low compression ratio; for example in the case of the conductor made of aluminum or aluminum alloy. Even when the conductor is made of aluminum or aluminum alloy on which a surface oxide film is easily formed, the higher compression of the tip end side part of the conductor enables the oxide film to be broken to lower the contact resistance while the suppressed compression of the base side part in comparison with the tip end side part allows the mechanical strength to be ensured.

The invention claimed is:

1. A crimp terminal having an electric connection portion which is fitted to a counterpart terminal to thereby make an electrical connection therewith and a wire crimp portion which is crimped to an end of a wire in which end a conductor is exposed, the wire crimp portion comprising a basal portion extending in an axial direction from the electric connection portion, and a conductor barrel which is formed of a metal plate extending from the basal portion across the axial direction and bent so as to hold the exposed conductor on the end of the wire, the conductor barrel having a front end and a rear end and including an inner surface which is brought into close contact with the conductor by the bending of the conductor barrel, the inner surface including a first inner surface which is formed continuously in the axial direction in a first area from the rear end to an intermediate position between the front and rear ends of the conductor barrel and closely contacts a base side part of the conductor and a second inner surface which is formed continuously in the axial direction in a second area from the intermediate position to the front end and closely contacts a tip end side part of the conductor and having such a shape that the second surface inwardly projects beyond the first surface to perform, by the bending, a higher compression of the tip end side part of the conductor than that of the base side part of the conductor.

2. The crimp terminal according to claim 1, wherein the conductor barrel is formed into such a shape that the first inner surface which closely contacts the base side part of the conductor is recessed beyond the second inner surface which closely contacts the tip end side part of the conductor.

3. The crimp terminal according to claim 1, wherein a specific peripheral edge part of the metal plate constituting the conductor barrel is folded back inwardly such that a front surface of the folded-back part forms the second inner surface of the conductor barrel.

4. A crimp terminal having an electric connection portion which is fitted to a counterpart terminal to thereby make an electrical connection therewith and a wire crimping portion which is crimped to an end of a wire in which an end conductor is exposed, the wire crimping portion comprising a basal portion extending in an axial direction from the electric connection portion. and a pair of conductor barrels formed of metal plates extending from right and left sides of the basal portion respectively across the axial direction and bent so as to hold the exposed conductor on the end of the wire, the conductor barrels including an inner surface which is brought into close contact with the conductor by the bending of the conductor barrel, wherein each of the conductor barrels has an outside edge portion which is an end, in a direction in which the conductor barrel of metal plates extend, of the metal plate, the outside edge portion having a width increasing with closing to a tip end side of the conductor and inwardly folded back such that a front surface of the folded-back outside edge portion forms a second inner surface of the conductor barrel.

5. A terminal-provided wire, comprising:

a wire having an end in which a conductor is exposed; and the crimp terminal according to claim 1, which is crimped to the end, the conductor barrel of the crimp terminal being crimped to the conductor so as to hold the conductor on the end of the wire by the bending thereof.

6. The terminal-provided wire according to claim 5, wherein the conductor barrel is crimped to the conductor such that a crimp height of the conductor barrel is uniform in the axial direction.

7. The terminal-provided wire according to claim 5, wherein a part of the basal portion corresponding to the tip end side part of the conductor protrudes inwardly and radially of the conductor beyond a part corresponding to the base side part of the conductor.

8. The terminal-provided wire according to claim 5, wherein the conductor is made of aluminum or aluminum alloy.

9. A method of manufacturing a terminal-provided wire comprising a wire having an end in which a conductor is exposed and a crimp terminal which is crimped to the end, the method comprising:

a terminal forming step of forming the crimp terminal according to claim 1 from a metal plate; and a crimping step of crimping the conductor barrel of the crimp terminal onto the conductor by setting the conductor on the end of the wire in the wire crimp portion of the crimp terminal and bending the conductor barrel such that the conductor barrel holds the conductor on the end of the wire.

10. The method of manufacturing a terminal-provided wire according to claim 9, wherein, in the terminal forming step, the first inner surface is press-formed such that the second inner surface inwardly projects beyond the first surface.

11. The method of manufacturing a terminal-provided wire according to claim 9, wherein, in the terminal forming step, a specific peripheral edge part of the metal plate constituting the conductor barrel is folded back inwardly such that a front surface of the folded-back part forms the second inner surface of the conductor barrel.

12. The method of manufacturing a terminal-provided wire according to claim 9, wherein, in the crimping step, the basal portion of the wire crimp portion of the crimp terminal is deformed such that a part of the basal portion corresponding to the tip end side part of the conductor has a shape of protruding inwardly and radially of the conductor beyond a part corresponding to the base side part of the conductor.

13. The method of manufacturing a terminal-provided wire according to claim 9, wherein the conductor is made of aluminum or aluminum alloy.

14. A method of manufacturing a terminal-provided wire comprising a wire having an end in which a conductor is exposed and a crimp terminal which is crimped to the end, the method comprising:

a terminal forming step of forming the crimp terminal according to claim 4 from a metal plate; and a crimping step of crimping the conductor barrel of the crimp terminal onto the conductor by setting the conductor on the end of the wire in the wire crimping portion of the crimp terminal and bending the conductor barrel such that the conductor barrel holds the conductor on the end of the wire.

15. The method of manufacturing a terminal-provided wire according to claim 14, wherein, the outside edge portion is folded back in the terminal forming step.

16. The method of manufacturing a terminal-provided wire according to claim 14, wherein, in the crimping step, the basal portion of the wire crimping portion of the crimp terminal is deformed such that a part of the basal portion corresponding to a tip end side part of the conductor has a shape of protruding inwardly and radially of the conductor beyond a part corresponding to the base side part of the conductor.

17. The method of manufacturing a terminal-provided wire according to claim 14, wherein the conductor is made of aluminum or aluminum alloy.

* * * * *